US006802466B1

(12) United States Patent
Van Der Zanden

(10) Patent No.: US 6,802,466 B1
(45) Date of Patent: Oct. 12, 2004

(54) DEVICE FOR SYNCHRONOUSLY AND SYMMETRICALLY MAKING MATERIAL COLLIDE

(75) Inventor: Johannes Petrus Andreas Josephus Van Der Zanden, Ring of Kerry, Dunkilla, Tahilla, Co. Kerry (IE)

(73) Assignees: Rosemarie Johanna Van Der Zanden, Tahilla (IE); Johannes Petrus Andreas Josephus Van Der Zanden, Tahilla (IE); IHC Holland N.V., Kinderdijk (NL)

( * ) Notice: Subject to any disclaimer, the term of this patent is extended or adjusted under 35 U.S.C. 154(b) by 82 days.

(21) Appl. No.: 10/088,640

(22) PCT Filed: Sep. 19, 2000

(86) PCT No.: PCT/NL00/00668

§ 371 (c)(1),
(2), (4) Date: Jul. 25, 2002

(87) PCT Pub. No.: WO01/21313

PCT Pub. Date: Mar. 29, 2001

(30) Foreign Application Priority Data

Sep. 20, 1999 (EP) ..... 99203080

(51) Int. Cl.[7] ..... B02C 19/00
(52) U.S. Cl. ..... 241/275

(58) Field of Search ..... 241/275, 5

(56) References Cited

U.S. PATENT DOCUMENTS 3,652,023 A 3/1972 Wood

FOREIGN PATENT DOCUMENTS

| | | |
|---|---|---|
| EP | 0 677 328 A1 | 10/1995 |
| EP | 0 835 690 A1 | 4/1998 |
| WO | WO 96/32196 | 10/1996 |

*Primary Examiner*—Mark Rosenbaum
(74) *Attorney, Agent, or Firm*—Young & Thompson

(57) ABSTRACT

A synchrocrusher for making a material collide in which the rotor is designed with a symmetric configuration. The rotor contains equal numbers of respectively forward and backward directed guide members and co-rotating impact members which are arranged, as synchronized pairs, in each direction of rotation. The pairs are circumferentially disposed uniformly at equal angural distances around the axis of rotation with the forward and backward directed configurations mirror imaged to each other. By combining or joining together pairs of respective forward and backward directed guide and co-rotating impact members, in respective guide and impact combinations and guide and impacts units, a supersymmetry configuration is achieved, which allows for many interesting synchrorotor configurations.

33 Claims, 12 Drawing Sheets

DEVICE FOR SYNCHRONOUSLY AND SYMMETRICALLY MAKING MATERIAL COLLIDE

This application is a 371 of PCT/NL00/00668 filed Sep. 19, 2000

FIELD OF THE INVENTION

The invention relates to the field of making material, in particular granular or particulate material, collide, with the object of breaking the grains or particles.

BACKGROUND OF THE INVENTION

According to a known technique, material can be broken by subjecting it to an impulse loading. An impulse loading of this kind is created by allowing the material to collide with an impact member, for example a wall, at high speed. It is also possible, in accordance with another option, to allow particles of the material to collide with each other. The impulse loading results in microcracks, which are formed at the location of irregularities in the material. These microcracks continuously spread further under the influence of the impulse loading until, when the impulse loading is sufficiently great or is repeated sufficiently often and quickly, ultimately the material breaks completely and disintegrates into smaller parts. To break the material, it is a precondition that the impact member be composed of harder material than the impacting material; or is at least as hard as the impacting material. The degree of comminution achieved, or breakage probability, increases with the impulse loading. Impact loading always results in deformation and, often considerable, wear of the impact member.

The movement of the material is frequently generated under the influence of centrifugal forces. In this process, the material is centrifugally thrown from a quickly rotating vertical shaft rotor, in order then to collide at high speed with an impact member which is positioned around the rotor. The impact member (impact face) can be formed by a hard metal face (armoured ring), but also by grains or a bed of its own material (autogenous ring). The later case is an autogenous process, and the wear during the impact remains limited. It is also possible to make the particles collide with an impact member that co-rotates with the rotor at a greater radial distance than the location from where the particles are centrifugally thrown.

The impulse forces generated in the process are directly related to the velocity at which the material leaves the rotor and strikes against the stationary or co-rotating impact member. In other words, the more quickly the rotor rotates in a specific configuration, the better the breaking result will be. Furthermore, the angle at which the material strikes the impact member has an effect on the breaking probability. The same applies to the number of impacts which the material undergoes or has to deal with and how quickly in succession these impacts take place.

A distinction can be drawn between single impact crushers, in which the material is loaded by a single impact, indirect double impact crushers, in which the material is accelerated again after the first impact and loaded by a second impact, which process can be repeated further, and direct double impact crushers, in which the material is loaded in immediate succession by two or more impacts which can be achieved by throwing the material against the co-rotating impact member: Direct double impact is normally preferred, since this considerably increases breakage probability, because during co-rotating impact the particles are simultaneously loaded and accelerated for direct successive secondary impact, with secondary impact velocity exceeding primary impact velocity; while energy consumption is virtually similar to single impact (indirect double impact doubles energy consumption).

In the known single impact crushers, the impact faces, which form an armoured ring around the rotor, are generally disposed in such a manner that the impact (stone-on-steel) in the horizontal plane as far as possible takes place perpendicularly. The specific arrangement of the impact faces which is required for this purpose means that the armoured ring as a whole has a type of knurled shape with numerous projecting corners. A device of this kind is known from U.S. Pat. No. 5,248,101. In the known method impact is heavily disturbed by the projecting corners which affects up to two-thirds of the particles. This causes wear rate along the armoured ring to be extremely high, while breaking probability is reduced significantly. Unfortunately, remaining elastic energy (rebound velocity) cannot be used to produce direct double impact because it is virtually impossible to locate secondary impact plates in an effective position. Only single impact can therefore be achieved. The centrifugal acceleration phase which does not contribute to the loading of the particle, but causes heavy wear along the impeller blade which is a major cause of concern with these type of crushers.

Instead of a stationary armoured ring a stationary trough structure may be disposed around the edge of the rotor, in which trough an autogenous bed, or autogenous ring, of the same material builds up. The centrifugally thrown material then strikes (stone-on-stone) the autogenous ring. A device of this kind is known from EP 0 074 771. The level of comminution of the known method is however limited, and the crusher is primarily employed for the after-treatment of granular material by means of rubbing the grains together, and in particular for "cubing" irregularly shaped grains. U.S. Pat. No. 4,575,014 has disclosed a device with an autogenous rotor blade, from which the material is centrifugally thrown against an armoured ring (stone-on-steel) or a bed of the same material (stone-on-stone).

U.S. Pat. No. 5,863,006 discloses a method for simultaneously loading and accelerating material that is metered on a horizontally disposed meter face which rotates about a vertical axis of rotation; this meter face is however separately supported on bearings and is as a whole carried by a vertical shaft which also carries a cylindrical rotor which wall is positioned concentrically around the meter face. Because of the separate bearing the meter face rotates at a lower velocity than the rotor. The material is supposed to be centrifugally thrown from this meter face and to collide with the wall of the rotor, which rotates at a much higher peripheral velocity than the meter face; and to build up an autogenous wall of own material, that acts as a co-rotating autogenous ring. This way co-rotating autogenous impact is supposed to take place with a high (relative) velocity, while wear is limited to a minimum. The material is then led to leave the rotor via ports in the wall and is then thrown against a stationary autogenous ring which is situated around the rotor for secondary autogenous impact. The comminution intensity during primary impact is however limited because the material is actually "floating freely" from the meter face (the material does not feel this rotating face) towards the co-rotating autogenous impact face, along which trajectory the particles are gradually accelerated and taken up in the autogenous ring. The intended level of impact does not materialize. Moreover, it is very difficult to keep a rotor, containing such "huge" autogenous ring, in balance; this requires special measures to be taken, which are described in U.S. Pat. No. 5,863,006 and makes the construction extremely complicated. The known method does not essentially differ from the method disclosed in DE 31 16 159.

A much better level of comminution intensity and comminution efficiency is obtained with a known method for direct successive double impact generated by a co-rotating impact member, which is disclosed U.S. Pat. No. 5,860,605 and is in the name of applicant. This known method, the synchrocrusher, features the synchroprinciple which allows for simple design, utilization of the principle of relativity, universal synchronization and above all provides fully deterministic behaviour. The material is metered on a meter face, central on the rotor, and from there taken up by guide members which are positioned around the meter face and are relatively short and preferably aligned backwards. From these guide members the material is centrifugally thrown, with a relative low take off velocity, into the direction of co-rotating impact members which are located at a greater radial distance from the axis of rotation than the guide members. During co-rotating impact, which proceeds in a fully deterministic way, the particles are simultaneously loaded and accelerated. After co-rotating impact the accelerating particles, or particle fragments, are being thrown against a stationary impact member which is disposed around the rotor. The power generated by this combination is unsurpassed in comminution technology. The known synchrocrusher delivers full impact loading, which makes it possible to achieve a level of commninution intensity and efficiency that exceeds all commercial available comminution methods. Each particle is uniformly and accurately loaded by unimpeded double impact. Both primary and secondary impact are achieved at specified impact velocities, at selected angles of impact and at fixed impact locations. Primary impact takes place against a co-rotating impact member. Secondary stationary impact, which is generated solely by residual energy, exceeds primary impact velocity and takes place against either an armoured ring (direct double stone-on-steel impact) or an autogenous ring (a combination of stone-on-steel and stone-on-stone impact). Because primary impact proceeds undisturbed and secondary impact is obtained free of charge, outstanding performance is obtained: The known synchrocrusher makes it therefore possible to double the impact intensity achieved by a conventional stone-on-steel vertical-shaft impactor and to double comminution efficiency by combining the conventional stone-on-steel and stone-on-stone vertical-shaft impactors: in both cases with the energy consumption of only one.

U.S. Pat. No. 6,032,889 (Trasher, A) describes and autogenous rotor which is balanced by steel balls in a circular tube attached to the rotor for reducing vibration of the rotor. Such balance system has been known for over a hundred years, such as U.S. Pat. No. 229,787 (Withee). Recent publications on this system can be found in Julia Marshall: Smooth grinding (Evolution, business and technology magazine from SKF, No. 2/1994, pp. 6–7) and in Auto-Balancing by SKF (publication 4597 E, 1997–03).

SUMMARY OF THE INVENTION

The known devices for loading and simultaneously accelerating granular materials by co-rotating impact and then making them collide for secondary impact, with the aim of breaking or comminuting, has been found to have certain drawbacks.

For example, because of fully deterministic behaviour, in the known synchrocrusher primary impact takes place at the co-rotating impact plates at concentrated areas which causes high wear rates at these points. Compared with a conventional single impact crushers, where stationary impact takes place against an armoured ring and wear is spread over a great number (10 to 20) of stationary impact plates, co-rotating impact in the known synchrocrusher is concentrated at the centre of a limited number (3 or 4) of co-rotating impact plates, which consequently wear-off much faster than an armoured ring. On the other hand, co-rotating impact avoids impact disturbance along corners and edges of the impact plates, which increases impact intensity dramatically and limits total wear. Although in the known synchrocrusher total impact wear to achieve a specific comminution intensity is normally significantly lower; when compared with a conventional single impact crusher, co-rotating impact plates have normally to be exchanged more frequently than stationary impact plates. However, the limited number of impact plates make it possible to use extremely hard (and expensive) wear resistant material with a very long stand time; for example tungsten carbide which has proven to be most suitable for this purpose. Still, standtime can be relatively short.

Another problem with the known synchrocrusher is the construction of the rotor in which the co-rotating impact members have to be aligned strongly eccentrically, when seen from the radial line between the axis of rotation and the co-rotating impact member, which causes an irregular and complicated stress pattern in the rotor. This makes it necessary to design the rotor construction relatively heavy, which consumes additional rotational energy and requires stronger shaft and bearings; amongst others. Also the suspension of the co-rotating impact members is rather complicated, making it difficult to exchange wear parts.

Furthermore, the known synchrocrusher does not allow for co-rotating impact to take place against a co-rotating autogenous bed of own material, which would limit wear significantly but has a lower level of comminution intensity; however the comminution efficiency of such autogenous impact is high.

The object of the invention is therefore to provide a device which does not exhibit these drawbacks, or at least does so to a lesser extent. This object is achieved by means of making a material collide in a synchrocrusher in which the rotor is designed with a symmetric configuration; that is, the rotor contains equal numbers of respectively forward and backward directed guide members and co-rotating impact members which are or can be arranged, as associated (synchronized) pairs, in each direction of rotation; which pairs are circumferentially disposed uniformly at equal angular distances around the axis of rotation with the forward and backward directed configurations mirror imaged (symmetrically) to each other. By combining or joining together pairs of respective forward and backward directed guide and co-rotating impact members, in respective guide and impact combinations and guide and impact units, supersymmetry is achieved. Such supersymmetry is very effective and allows for many interesting supersymmetrical configurations.

Most important of all, a symmetrical configuration allows for the rotor to operate in both forward and backward direction of rotation, effectively doubling the standtime of the rotor. A supersymmetrical configuration makes it possible to increase the number of forward and backward co-rotating impact members and associated guide members dramatically, increasing standtime with four times and more when compared with the known synchrocrusher. As will be explained later symmetrical guide combinations allow for a design which does not essentially hinder the particle flow to proceed from the meter face to the respective central feeds of the guide members; and therefore does allow for maximum capacity. Very interestingly, the guide and impact combinations and units can be designed in such a way that they take their respective forward and backward position automatically under influence of the rotational force applied only, as will be explained later.

Furthermore, a supersymmetric design allows for the guide and impact combinations and units to create essentially only circumferentially regularly distributed radially directed forces resulting in a regularly distributed stress pattern in the rotor construction, which makes it possible to construct the rotor relatively light and simple; in particular when the combinations and units are pivotly attached to the rotor avoiding bending moments at these locations. Supersymmetrically designed combinations, in particularly units of guiding and impact members, are eminently suitable for such pivotly attachment which makes them also easy to replace; pivotly attachment is therefore a preferred option. Both the combination and units can be designed and attached in different ways as will be explained later.

Moreover, by positioning pairs (units) of co-rotating impact members together, front to front, a symmetrical inward directed acute cavity is formed between the impact faces, in which cavity a bed of own material can accumulate under influence of centrifugal forces, creating autogenous or semi-autogenous impact faces depending on the precise way (distance of each other) the impact faces are positioned. This makes it possible to limit wear to a considerable degree, all the more because after impact the material is guided downwards in front of these cavities and accelerated underinfluence of gravitational force; the material therefore leaves the rotor in a rather "natural way" avoiding extreme wear along the inner bottom edges (tips) of the rotor, which is a major cause of concern with conventional autogenous rotors, where the particles leave the rotor in horizontal direction (plane of rotation) causing great wear along the tip ends. Autogenous impact has limited comminution efficiency (defined as the amount of new surface produced per unit of externally applied energy for unit mass of material) which level can however be significantly be increased by creating a semi-autogenous impact face where the particles hit partly own material and partly the impact face against which the autogenous bed accumulates. However, comminution efficiency of such autogenous impact is generally very good; for example when the purpose of the comminution process is to clean or shape the particle material.

Furthermore, the device of the invention make it possible to design the rotatable collision means (or co-rotating impact members) as a co-rotating autogenous ring, avoiding impact wear altogether, while wear along the inner bottom edge of such autogenous ring, along which the material leaves the rotor, is limited as explained before. Such a co-rotating autogenous ring can of course also be operated in one direction of rotation only. The possibility to reverse the direction of rotation has however the advantage that it is possible to clean up (freshen) the bed of own material; that is, such autogenous ring has a strong tendency to accumulate a huge (predominantly) amount of fines, creating a so called dead bed which reduces the autogenous intensity.

Finally, the device of the invention make it also possible to apply a configuration that is indirect symmetrical; that is assembling one directional impact members in a co-rotating autogenous ring, which impact members are each associated with either a forward or a backward directed guide member. Such indirect symmetrical configuration makes it possible to operate the rotor as a steel impact crusher in one direction of rotation and as an autogenous impact crusher in the opposite direction of rotation.

To reduce vibration which occurs when the rotor becomes unbalanced, for example because of non-regular wear development of the different wear parts, a circular hollow balance ring can be placed on the rotor, which balance ring is at least partly filled with oil and contains one or more balls which are composed of a steel alloy, chrome steel of tungsten carbide, or a ceramic material. The rotor can be equipped with one balance ring which can contain coarser balls or two or more balance rings which fit into each other and can contain smaller balls. The balance rings can also be placed on top of each other or at different levels.

During co-rotating impact the particles are simultaneously loaded and accelerated for direct secondary impact, as is the case in he known synchrocrusher. Here secondary impact can be applied more effectively then is the case with the known synchrocrusher, because secondary impact members can also be equipped with both forward and backward directed impact faces doubling their standtime.

So, the device of the invention for making material collide in an essentially deterministically, synchronously and (super)symmetrically manner offers a considerable number of interesting possibilities for practical applications.

The discussed objectives, characteristics and advantages of the invention, as well as others, are explained, in order to provide better understanding, in the following detailed description of the invention in conjunction with the accompanying diagrammatic drawings.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

The device of the invention is related to U.S. Pat. No. 5,860,605, which is in the name of applicant and discloses in detail how a synchrocrusher configuration can be designed; that is the alignment of the guide member, the radial distance from the axis of rotation where the material is taken up by the central feed of the guide member and leaves the delivery end of the guide member, which parameters determine, together with the coefficient of friction, the flight path the particles describe when centrifugally thrown from the delivery end. Depending on impact radius and rotational velocity a synchronisation angle ($\theta$) can be calculated for exact synchronously positioning of the co-rotating impact member which is associated with the guide member. All synchrocrusher configurations here discussed and diagrammatically illustrated rest on U.S. Pat. No. 5,860,605 and have been designed with the help of a special developed computer simulation programm.

The development of the synchrocrusher is further described in "Hans van der Zanden, et all, SynchroCrusher-21st century crushing technology, Developments in quarrying and recycling, Jun. 21, 1999, The Institute of Quarrying".

Figure 1:
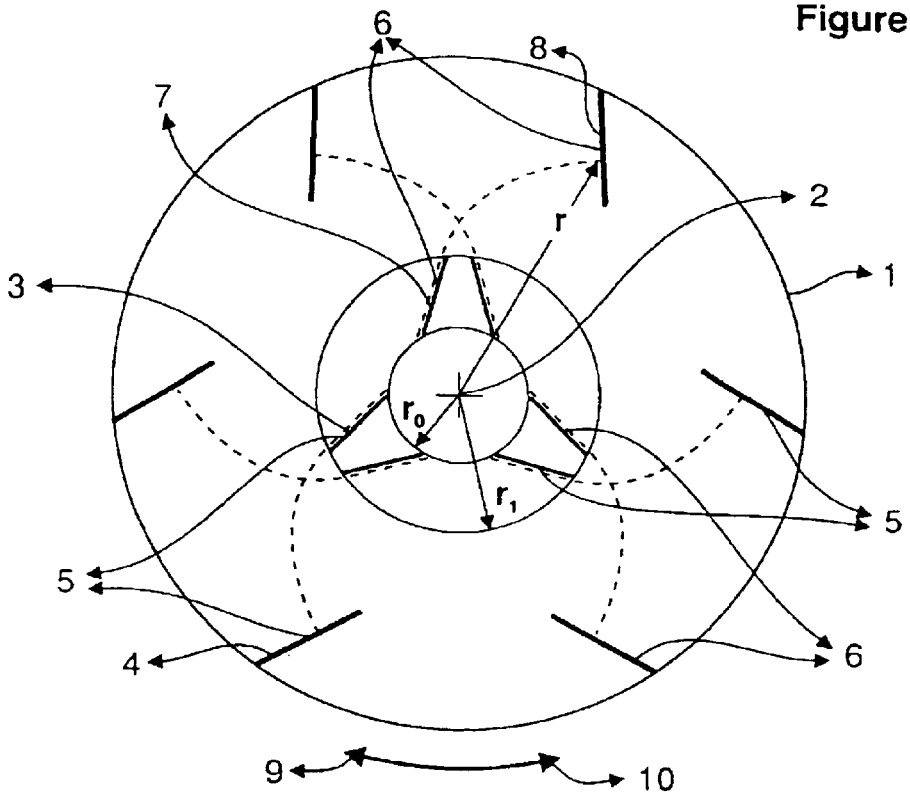
FIG. 1 diagrammatically illustrates a basic symmetric configuration of the rotor which can rotate in both forward an backward direction.

FIG. 1 diagrammatically illustrates a basic symmetric configuration of a rotor (1) which can rotate about a vertical axis of rotation (2) in either forward (9) or backward (10) direction. The rotor (1) is equipped with forward directed guide members (3) which are each synchronously associated with a forward directed impact member (4), which forward associated pairs (5) are circumferentially disposed uniformly at equal angular distances around the axis of rotation (2). The rotor (1) is further equipped with symmetrically identical backward directed synchronously associated pairs (6) of backward directed guide members (7) and impact members (8) which backward pairs (5) are also circumferentially disposed uniformly at equal angular distances around the axis of rotation (2), mirror (symmetrical) imaged to the forward pairs (6).

Figure 2:
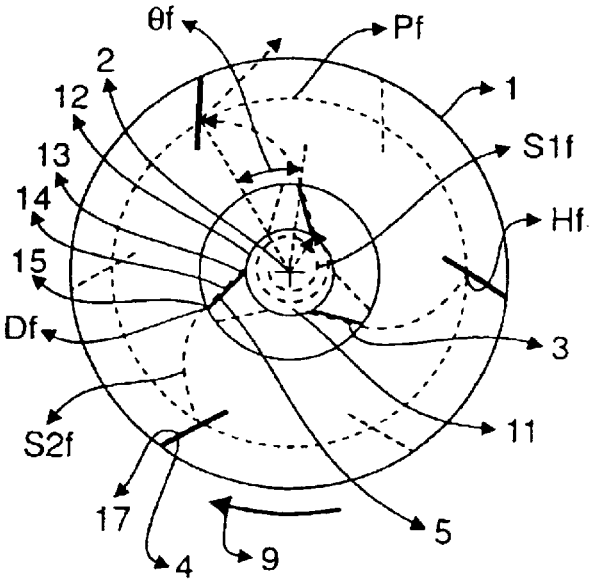
FIG. 2 diagrammatically illustrates the rotor from FIG. 1 rotating in forward direction.
Figure 3:
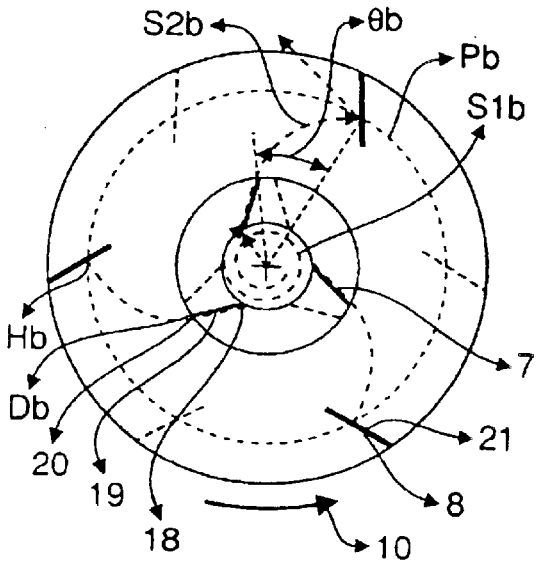
FIG. 3 diagrammatically illustrates the rotor from FIG. 1 rotating in backward direction.

FIG. 2 diagrammatically illustrates the configuration of FIG. 1 rotating in forward direction (9) while FIG. 3 illustrates the configuration of FIG. 1 rotating in backward direction (10). In the forward configuration the material is metered on the meter face (11) in a region close to the axis of rotation (2) and is from there directed to the edge of the meter face (11) in a first essentially spiral path (S1), when seen from a viewpoint which moves together with the guide members (3)(7), which first spiral path (S1) is directed backward when the rotor rotates in a forward direction (S1*f*) and is directed forward when the rotor rotates in a backward direction (S1*b*), when seen in the specific direction of rotation (9)(10).

The material is then fed in parts, as separate forward streams of material to the forward directed central feeds (13) of the respective forward directed guide members (14) and as separate backward streams of material (S1*b*) to a backward directed central feeds (18) of the respective backward directed guide members (8).

Each forward stream is then guided from the forward directed central feed (13), along a forward directed guide face (14), to a forward directed delivery end (15) of the forward directed guide member (3), which forward directed delivery end (15) is situated at a greater radial distance ($r_1$) from the axis of rotation (2) than ($r_0$) the forward directed central feed (13), while the backward stream is guided from the backward directed central feed (18), along a backward directed guide face (19), to a backward directed delivery end (20) of the backward directed guide member (7), which backward directed delivery end (20) is situated at a greater radial distance ($r_1$) from the axis of rotation (2) than ($r_0$) the backward directed central feed (18).

Each forward stream is then send in an essentially deterministic way, from a forward delivery location (Df) where the forward stream leaves the forward directed delivery end (15), into an essentially deterministic backward directed second spiral stream (S2*f*), when seen from a viewpoint which moves together with the forward directed delivery end (15) and seen in forward direction of rotation (9), while the backward stream is send in an essentially deterministic way, from a backward delivery location (Db) where the backward stream leaves the backward directed delivery end (20) into an essentially deterministic forward directed second spiral stream (S2*b*), when seen from a viewpoint which moves together with the backward directed delivery end (20) and seen in backward direction of rotation (10).

In forward rotation (9), each backward directed second spiral stream (S2*f*) then collides with the forward impact face (17) of a forward directed associated rotatable impact member (4), which impact face (17) is located behind, when seen in the direction of forward rotation (9), the radial line on which is situated an associated said forward delivery location (Df) and at a greater radial distance (r) from the axis of rotation than the associated forward delivery location (Df) and the location is determined by selecting a forward synchronization angle (θf) between the radial line on which is situated the associated forward delivery location (Df) and the radial line on which is situated the location where an associated second backward directed spiral stream (S2*f*) of the as yet uncollided material and the forward path (Pf) of an associated forward directed impact face (17) intersect one another, which forward synchronization angle (θf) is selected in such a manner that the arrival of the as yet uncollided material at the associated forward hit location (Hf) where the associated second backward directed spiral stream (S2*f*) and the forward path (Pf) intersect one another is synchronized with the arrival, at the same location, of the associated forward directed impact face (17), when seen from a viewpoint which moves together with the associated forward rotatable impact member (4), which associated forward directed impact face (17) is directed virtually transversely, when seen in the plane of the forward rotation (9), to the backward directed second spiral stream (S2*f*), when seen from a viewpoint which moves together with the associated forward rotatable impact member (4).

In backward rotation (10), each forward directed second spiral stream (S2*b*) then collides with the backward impact face (21) of a backward directed associated rotatable impact member (8), which impact face (21) is located behind, when seen in the direction of backward rotation (10), the radial line on which is situated an associated backward delivery location (Db) and at a greater radial distance (r) from the axis of rotation than the associated backward delivery location (Db) and the location is determined by selecting a forward synchronization angle (θb) between the radial line on which is situated the associated backward delivery location (Db) and the radial line on which is situated the location where an associated second forward directed spiral stream (S2*b*) of the as yet uncollided material and the backward path (Pb) of an associated backward directed impact face (21) intersect one another, which backward synchronization angle (θb) is selected in such a manner that the arrival of the as yet uncollided material at the associated backward hit location (Hb) where the associated second forward directed spiral stream (S2*b*) and the backward path (Pb) intersect one another is synchronized with the arrival, at the same location, of the associated backward directed impact face (21), when seen from a viewpoint which moves together with the associated backward rotatable impact member (8), which associated backward directed impact face (21) is directed virtually transversely, when seen in the plane of the backward rotation (10), to the forward directed second spiral stream (S2*b*), when seen from a viewpoint which moves together with the associated backward rotatable impact member (8), which backward impact members (8) are positioned: in such a way that the forward directed second spiral streams (S2*b*) do not interfere with any of the forward directed impact faces (21).

The associations of forward and backward directed guide members and impact members are preferably positioned together in pairs with at least a part of the respective guide and impact members located at virtually the same position, creating a supersymmetric configuration. Impact members completely joined together, back to back, are called respectively adjacent guide combinations and impact combinations which can be pivotly attached to the rotor with their inner or outer segment, when seen from the axis of rotation as respectively inner and outer combinations. Joined together partly, either back to back or front to front, with either an inner or an outer section are called respectively guide combinations and impact units, which can be pivotly attached to the rotor with their inner or outer section resulting in respectively inner and outer units. Inner pivotly attachment has the advantage that the combination or unit is always radially directed, regardless the direction of rotation. Outer pivotly attachment has the advantage that the combination or unit switch position essentially automatically from forward into backward when direction of rotation is reversed. The respective combinations and units can also be adjustable and fixed attached.

Figure 4:
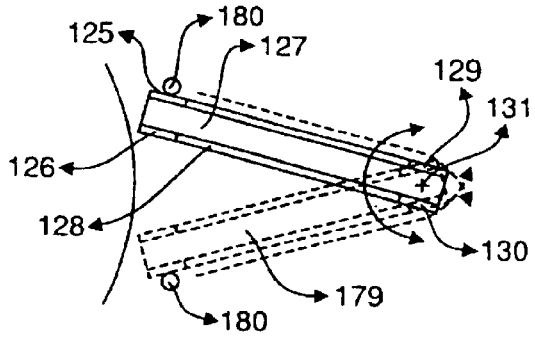
FIG. 4 diagrammatically illustrates an outer adjacent guide combination.

FIG. 4 diagrammatically shows an outer adjacent guide combination (124) in which arrangement the respective forward and backward directed central feeds (125)(126), guiding faces (127)(128) and delivery ends (129)(130) are joined together, mirror imaged back to back, which outer adjacent guide combinations can be optionally pivotly attached at an outer location (131) positioned between the delivery ends (129)(130). Such pivotly attached outer adjacent guide combination switches direction (124→179), essentially automatically, when direction of rotation is reversed, for which stopends (180) have to be located.

Figure 5:
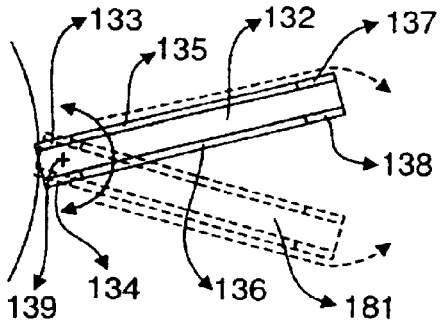
FIG. 5 diagrammatically illustrates an inner adjacent guide combination.

FIG. 5 diagrammatically shows an inner adjacent guide combination (132) in which arrangement the respective forward and backward directed central feeds (133)(134), guiding faces (135)(136) and delivery ends (137)(138) are joined together, mirror imaged back to back, which can be optionally pivotly, adjustable of fixed attached at an inner location (139) positioned between the central feeds (133)(134). In case direction of rotation is reversed it is normally necessary to change the position of the inner adjacent guide combination (132→181): when pivotly attached each position has to be fixed to hinder radial alignment under influence of centrifugal force. Such change of position has to be performed manually but can also proceed mechanically.

Figure 6:
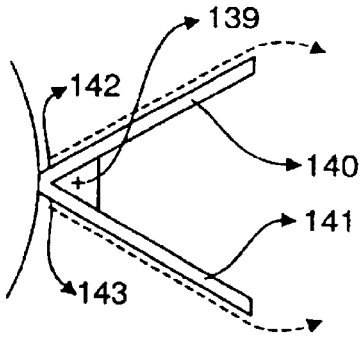
FIG. 6 diagrammatically illustrates an inner guide combination.

FIG. 6 diagrammatically shows an inner guide combination (139) which is normally fixed attached to the rotor, arranged with the respective forward (140) and backward (141) guide members located, mirror imaged back to back, close to each other, and the respective forward (142) and backward (143) directed central feeds joined virtually together at the same location. Such inner guide combination is normally backward aligned when seen in the specific direction of rotation. With backward alignment the associated impact member is positioned at a relative close distance from the guide member. Such backward alignment has however a strong accelerating capacity which consumes a considerable amount of energy and causes high wear rate, while the particle is centrifugally thrown from the delivery end at a relatively high velocity.

Figure 7:
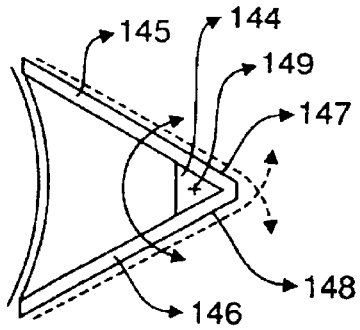
FIG. 7 diagrammatically illustrates a preferred outer guide combination.

FIG. 7 diagrammatically shows a preferred outer guide combination (144) for which pivotly attachment to the rotor is normally preferred, as will be explained later, arranged with the respective forward (145) and backward (146) guide members located, mirror imaged back to back, close to each other and the pespective forward (147) and backward (148) directed delivery ends joined virtually together at the same location. Such outer guide combination is normally forward aligned when seen in the specific direction of rotation. This way the associated impact member is positioned at a relative long distance from the delivery end. Such forward alignment has the advantage that accelerating capacity is limited, which consumes a low amount of energy and causes limited wear rate, while the particle is centrifugally thrown from the delivery end at a relatively low velocity, which is preferred in a synchorotor. A pivotly attached outer guide combination (144) can be designed in such a way that particle traffic is not hindered. This will be explained in more detail later. Moreover, pivotly attachment makes it very easy to replace the units and makes this configuration a preferred arrangement.

Figure 8:
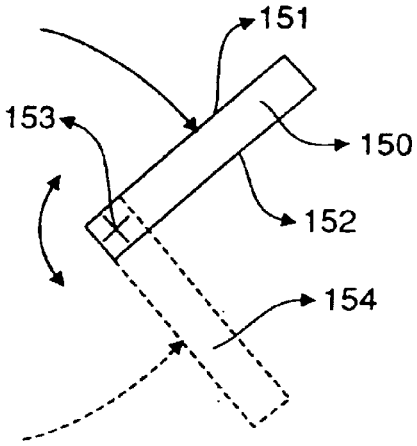
FIG. 8 diagrammatically illustrates an inner impact combination.

FIG. 8 diagrammatically shows an inner impact combination (150) arranged with the pespective forward (151) and backward (152) directed impact faces joined together, mirror imaged back to back against each other, which inner adjacent guide combination is normally pivotly attached (153) at a location close to the axis of rotation for positioning of the inner adjacent guide combination in either forward (150) or backward (154) direction. In case direction of rotation is reversed it is normally necessary to change the position of the inner impact combination (150→154), each of which positions has to be fixed to hinder radial alignment under influence of centrifugal force. Such change of position has to be performed manually but can also proceed mechanically.

Figure 9:
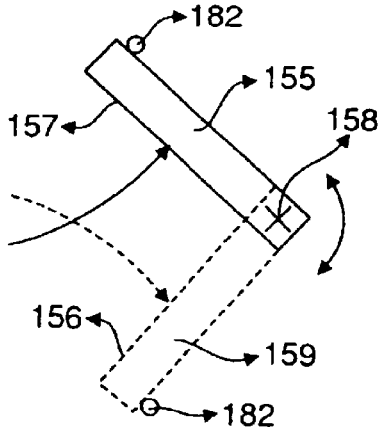
FIG. 9 diagrammatically illustrates an outer impact combination.

FIG. 9 diagrammatically shows an outer impact combination (155) arranged with the pespective forward (156) and backward (157) directed impact faces joined together, mirror imaged back to back against each other, which outer impact combination is normally pivotly attached (158) at a location close to the axis of rotation for positioning of the outer impact combination in either forward (155) or backward (159) direction. The outer impact combination switches direction (155→159), essentially automatically, when direction of rotation is reversed, for which stopends (182) have to be located. Moreover, outer impact combinations have a simple design and are relative easy to replace what makes them a preferred arrangement.

Figure 10:
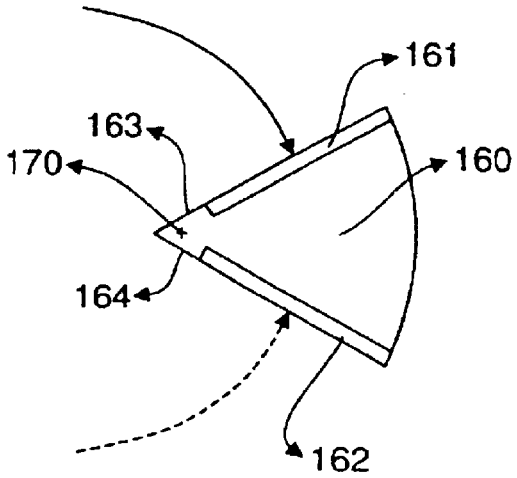
FIG. 10 diagrammatically illustrates a preferred inner impact unit.

FIG. 10 diagrammatically shows an inner impact unit (160) which arrangement is normally pivotly attached (170) to the rotor and is equipped with a forward (161) and backward (162) directed impact member, which are positioned, mirror imaged back to back, with their inner segments (163)(164) located virtually together. A pivotly attached inner impact unit is always radial aligned under influence of centrifugal force which causes only radial forces, and consequently a regular stress pattern, to develop in the rotor. Such forced radial alignment has the advantage that the position of a weared-off impact face is corrected for half automatically because of the shift in the centre of gravity of unit, while this makes it possible to align the other impact face in such a way that this impact face obtains its correct impact alignment when the other face is weared-off; this will be explained in more detail later. Moreover, such pivotly attached inner impact unit is very easy to replace and is therefore a preferred arrangement.

Figure 11:
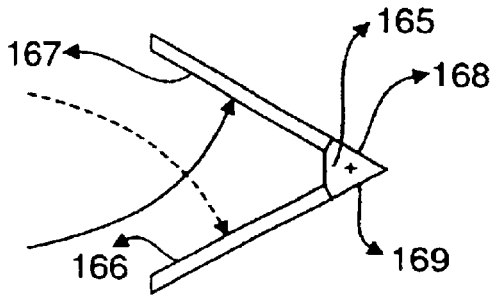
FIG. 11 diagrammatically illustrates an outer impact unit.

FIG. 11 diagrammatically shows an outer impact unit (165) which is normally fixed attached to the rotor and is equipped with a forward (166) and backward (167) directed impact member, which are positioned, mirror imaged back to back, with their outer segments (168)(169) located virtually together.

Figure 12:
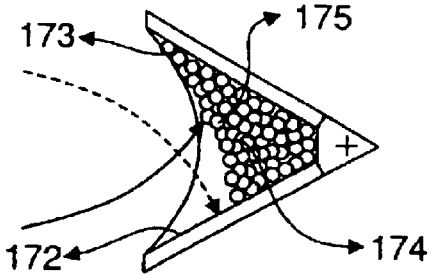
FIG. 12 diagrammatically illustrates an autogenous outer impact unit.

FIG. 12 diagrammatically shows an autogenous outer impact unit between which impact faces (172)(173) an acute cavity is formed where a bed of own material (174) can accumulate, under influence of centrifugal forces, which acts as an autogenous impact face (175).

Figure 13:
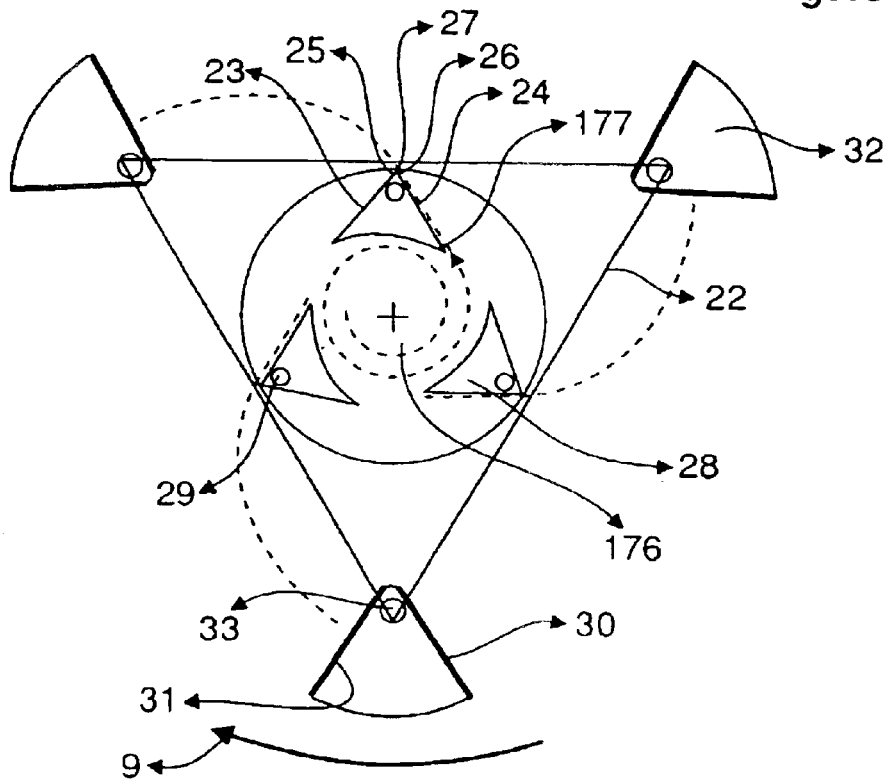
FIG. 13 diagrammatically illustrates a typical first supersymmetric preferred configuration of a rotor, rotating in forward direction, with triangular shape in which both the forward and backward directed guide members and associated impact members are positioned in such a way that pairs of the respective forward and backward directed guide members and the associated pairs of the respective impact members are each pivotly attached in respectively outer guide combinations and inner impact units.
Figure 14:
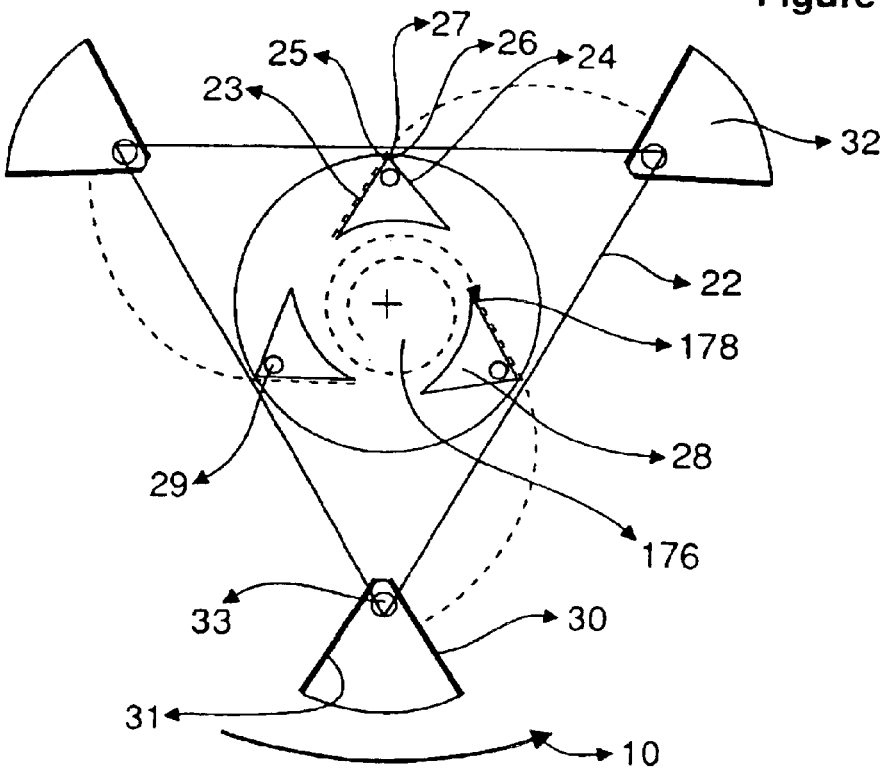
FIG. 14 diagrammatically illustrates the rotor from FIG. 4 rotating in backward direction.

FIG. 13 diagrammatically illustrates a forward directed and FIG. 14 a similar but backward directed first preferred supersymmetric configuration of a rotor (22) with a triangular shape (which is much lighter than a rotor (1) with a circular shape), which symmetric configuration is designed in such a way that the respective guide members (23)(24) are arranged in pairs, as outer guide combinations with the delivery ends (25)(26) virtually at the same location (27). This makes it possible to construct symmetric outer guide combinations (28) which each contain both a forward (23) and a backward (24) directed guide member. The outer guide combinations (28) can be pivotly attached (29), as shown, but of coarse also otherwise attached, for example clamped or fixed under influence of centrifugal force. Pivotly attached guide combinations (28) are here designed in such a way that the material flow from the meter face (176) to the respective central feeds (177)(178) of the guiding members (23)(24) is not hindered; which will be discussed later (FIG. 26) in more detail. In a similar way the impact members (30)(31) are constructed here as inner impact units (32), which each contain both a forward (30) and a backward (31) directed impact member (5), which has been pivotly attached (33), but can of course also be otherwise attached; that is, fixed or adjustable. The rotor of the invention is fully symmetric, which gives a regular stress pattern in the rotor during rotation, which makes the construction of the rotor relatively simple. Moreover, pivotly attached inner impact units (32) are easy to replace, while stand time is doubled when compared with a synchrorotor rotatable in one direction only, which makes this a preferred configuration.

Figure 15:
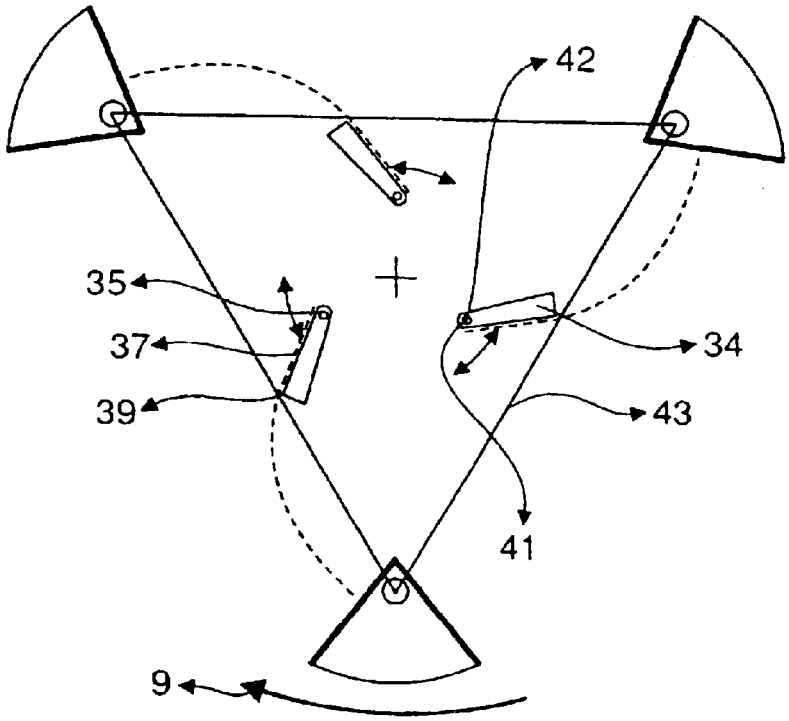
FIG. 15 diagrammatically illustrates a second symmetric configuration of a triangular rotor, rotating in forward direction, equipped with inner adjacent guide combinations adjustable attached and inner impact units pivotly attached.
Figure 16:
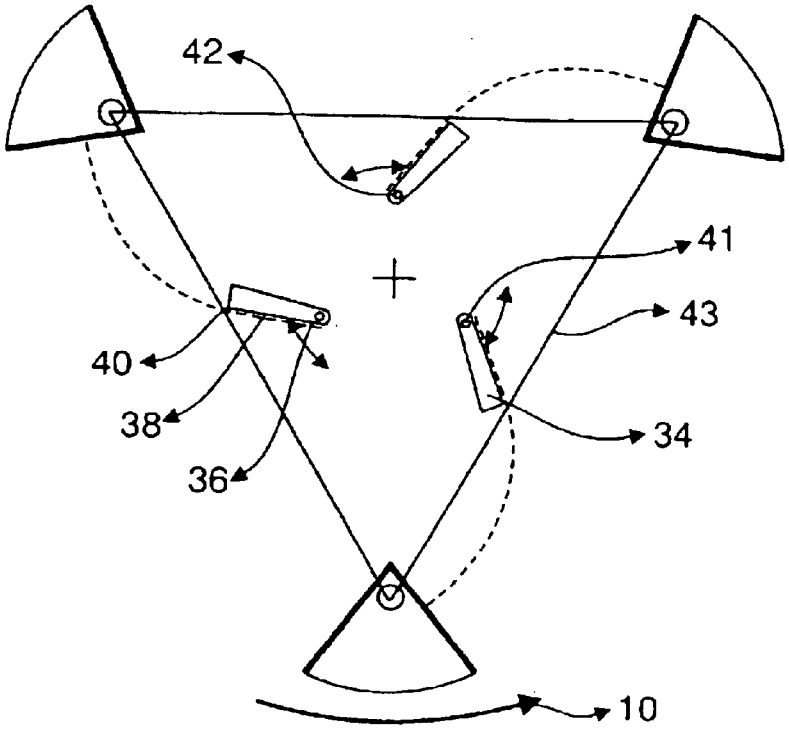
FIG. 16 diagrammatically illustrates the rotor from FIG. 15 rotating in backward direction.

FIGS. 15 and 16 show for respectively forward and backward rotation a second supersymmetric configuration of a triangular rotor (43) equipped with inner impact units like FIGS. 13 and 14; but with inner adjacent guide combinations (34), which are each equipped with a forward and a backward directed central feed (35)(36), guiding face (37)(38), and delivery end (39)(40) joined together back to back. Pivotly attachment (42) at a location near the central feeds, as here shown, makes it possible to choose backward and forward position easy, but has to be secured to resist centrifugal forces. Such adjacent guide combinations are also easy to replace. Of course other ways of attachments are possible.

Figure 17:
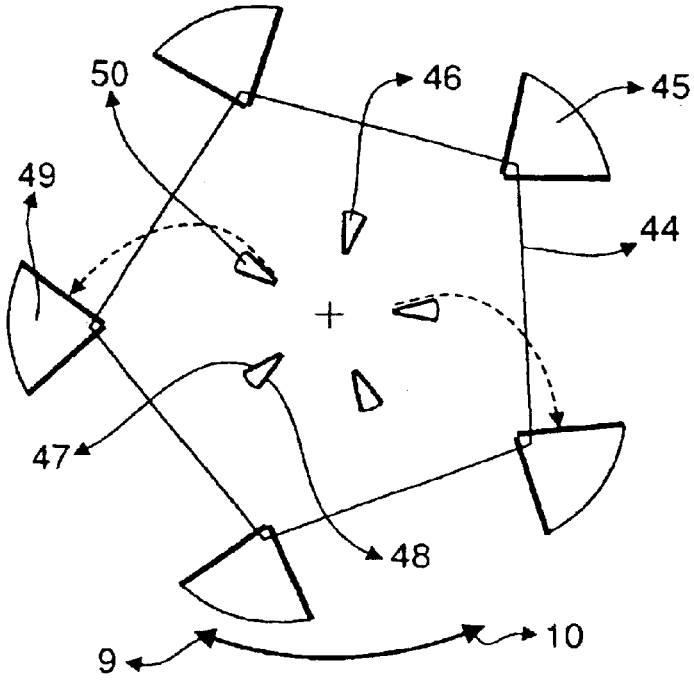
FIG. 17 diagrammatically illustrates a third supersymmetric configuration of a rotor with a shape of a pentagon with five inner guide combinations, fixed attached, and five associated inner impact units pivotly attached.

FIG. 17 shows a third supersymmetric configuration of a rotor (44) with the shape of a pentagon, to reduce weight, equipped with five inner impact units (45) each associated with a fixed adjacent guide combination (46). The large number of impact faces, here ten, increases standtime to a considerable degree. Such compact configuration, which can still handle a stream of relatively coarse particles, is possible because the respective adjacent guide combinations (47)(48) are aligned in a slight forward direction when seen in the direction (9)(10) in which the particular guide member (47)(48) rotates. Such forward alignment locates the impact unit (49) relatively close to the associated guide combination (50); when compared with backward alignment, but does increase energy consumption and wear rate.

Figure 18:
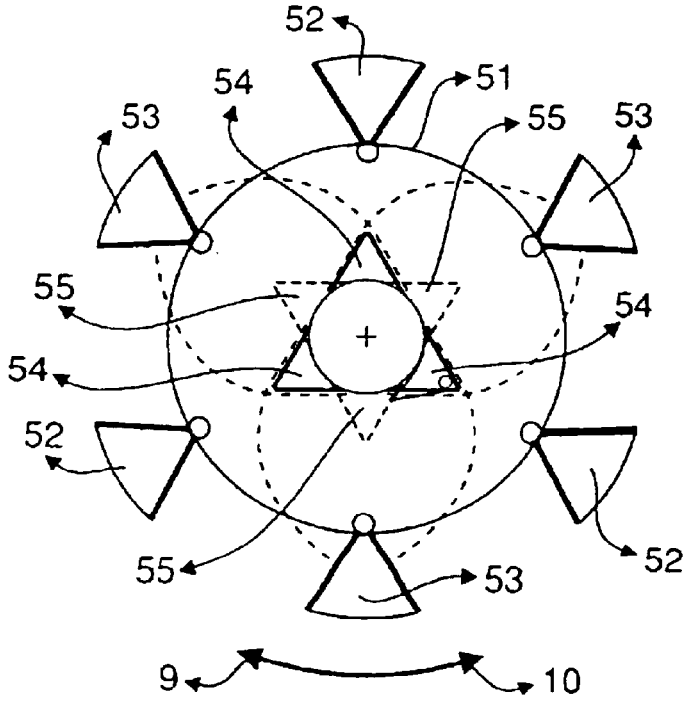
FIG. 18 diagrammatically illustrates a fourth supersymmetric configuration of a rotor with outer guide combinations, individually pivotly attached and collectively adjustable, and additional inner impact units which are attached in the middle in between the in place inner impact units, all impact units being pivotly attached.
Figure 19:
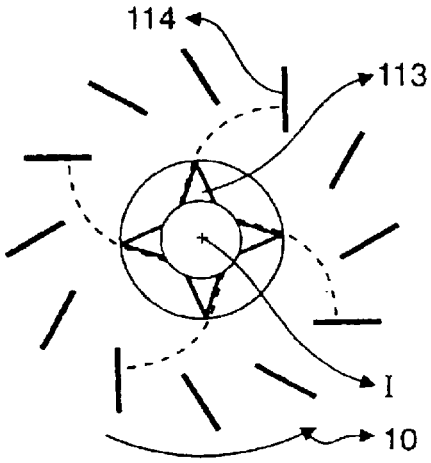
FIG. 19 diagrammatically shows a fifth supersymmetric configuration equipped with four outer guide combinations, collectively adjustable, and twelve inner impact units with the guide combinations in a first position rotating backwards, all units being pivotly attached.

FIG. 18 shows a fourth supersymmetric symmetric configuration of a rotor (51) with additional linked impact units (52), each positioned in the middle in between the in place impact units (53). When both impact faces of the in place impact units (53) have been weared out, the outer guiding units (54) can be turned collectively in such a way that they become associated (55) with the additional impact units (52). This makes possible, with a simple turn of the guide combinations (55), to double the standtime.

Figure 20:
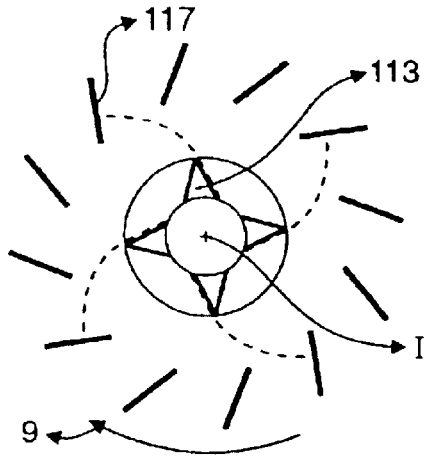
FIG. 20 diagrammatically shows the configuration from FIG. 19 with the guide combinations in a first position rotating forwards.
Figure 22:
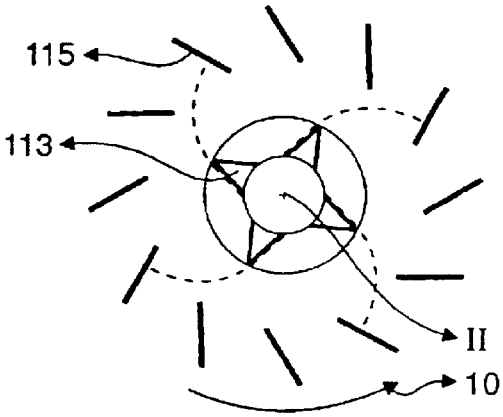
FIG. 22 diagrammatically shows the configuration from FIG. 19 with the guide combinations in a second position rotating backwards.
Figure 21:
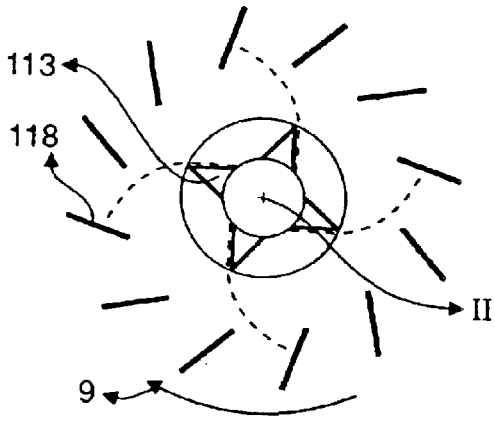
FIG. 21 diagrammatically shows the configuration from FIG. 19 with the guide combinations in a second position rotating forwards.
Figure 23:
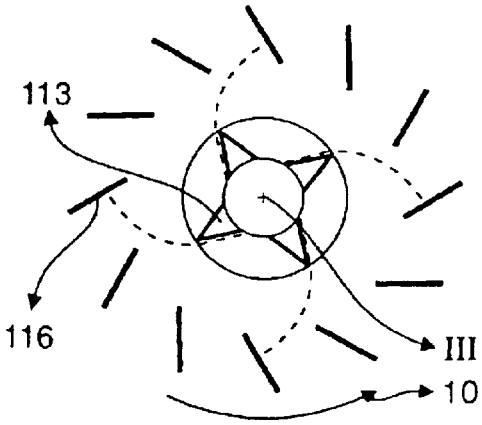
FIG. 23 diagrammatically shows the configuration from FIG. 19 with the guide combinations in a third position rotating backwards.
Figure 24:
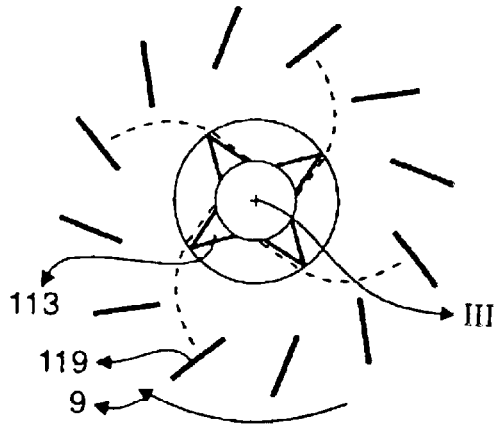
FIG. 24 diagrammatically shows the configuration from FIG. 19 with the guide combinations in a third position rotating forwards.

As an example, the real power of supersymmetric configuration is illustrated in FIGS. 19 to 23 which fifth supersymmetric configuration is equipped with four outer guide combinations (113) which can be collectively turned to adjust their position. Each of the guide combinations (113) is associated with six different impact faces which belong to six different linked inner impact units; that is three impact faces (114)(115)(116) directed backward (10) and three impact faces (117)(118)(119) directed forward (9). After the first associated backward impact face (114) (FIG. 19) is weared-off, rotation is reversed for the first time to forwards and the association of the guide combination (113) is transferred to a second associated forward impact face (117) (FIG. 20). When this second associated forward impact face (117) is weared-off, the position of the guide combination (113) is switched for the first time (from (I) to (II)), collectively with the other guide combinations, associating the guide combination (113) with a third forward directed impact face (118) (FIG. 21). When this third forward directed impact face (118) is weared-off, rotation is reversed for the second time to backward and the association transferred to a fourth backward directed impact face (115) (FIG. 22). Then the position of the guide combination (113) is switched for the third time (from (II) to (III)), transferring the association to a fifth backward directed impact face (116) (FIG. 23). When this fifth backward directed impact face (116) is weared-off rotation is reversed for the third time to forward, transferring the association to a sixth and last forward directed impact face (119) (FIG. 24). Then in total twentyfour impact faces have been weared-off and the impact units, and probably also the guiding units, have to be replaced. This fifth supersymmetric configuration makes it possible for a rotor to carry twelve impact units with twentyfour impact faces, while particle traffic from the meter face to the guiding members, from the guiding members to the impact members and from the impact members out of the rotor is not hindered. This allows for an extreme long standtime while a high capacity can be achieved and relatively coarse particles can be handled. It is clear that many other supersymmetric configurations can be designed; this fifth supersymmetric configuration can for example be equipped with three outer guide combinations which allows for even higher capacity and can handle even coarser particles.

Figure 25:
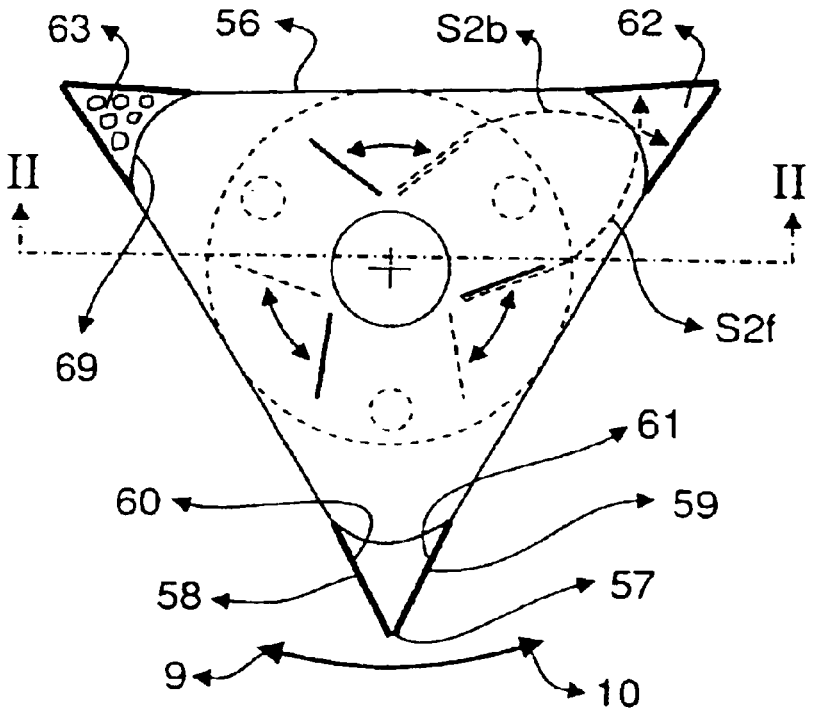
FIG. 25 diagrammatically shows a top view on I-I of a sixth supersymmetric configuration of a rotor equipped with adjacent guide combinations, adjustable attached, and outer impact units fixed attached with the impact faces positioned front to front creating a semi-autogenous impact unit FIG. 26 diagrammatically shows a longitudinal section on II-II of FIG. 25.
Figure 26:
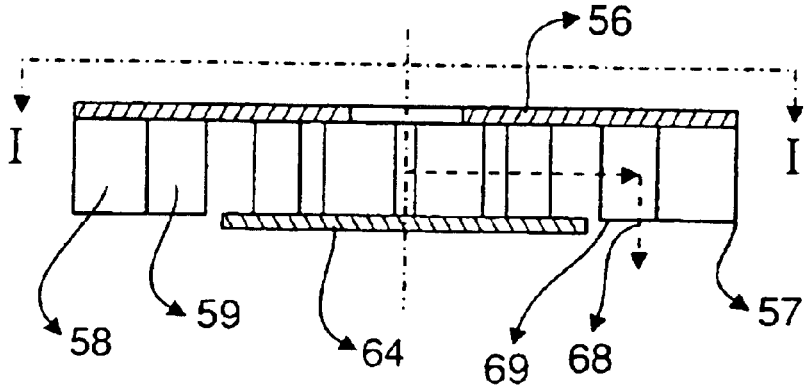

FIGS. 25 and 26 show a sixth supersymmetric configuration of a triangular rotor (56) equipped with inner adjacent guide combinations (57) and outer autogenous impact units which are positioned with the impact faces (60(61) directed, mirror imaged front to front with another. The centrifugally thrown material (S2*f*)(S2*b*) now enters the acute cavities (62) between the impact faces (60)(61) and can here build up a bed of own material (63) for (semi)autogenous impact, regardless of the direction of rotation. This way impact wear is reduced significantly. The bottom of the rotor (64) is open in front of each impact unit (67) for the discharge (68) of the material after impact in downward direction which limits sliding wear along the edges (69). Such configuration has however a somewhat lower level of comminution intensity when compared with steel impact.

Figure 27:
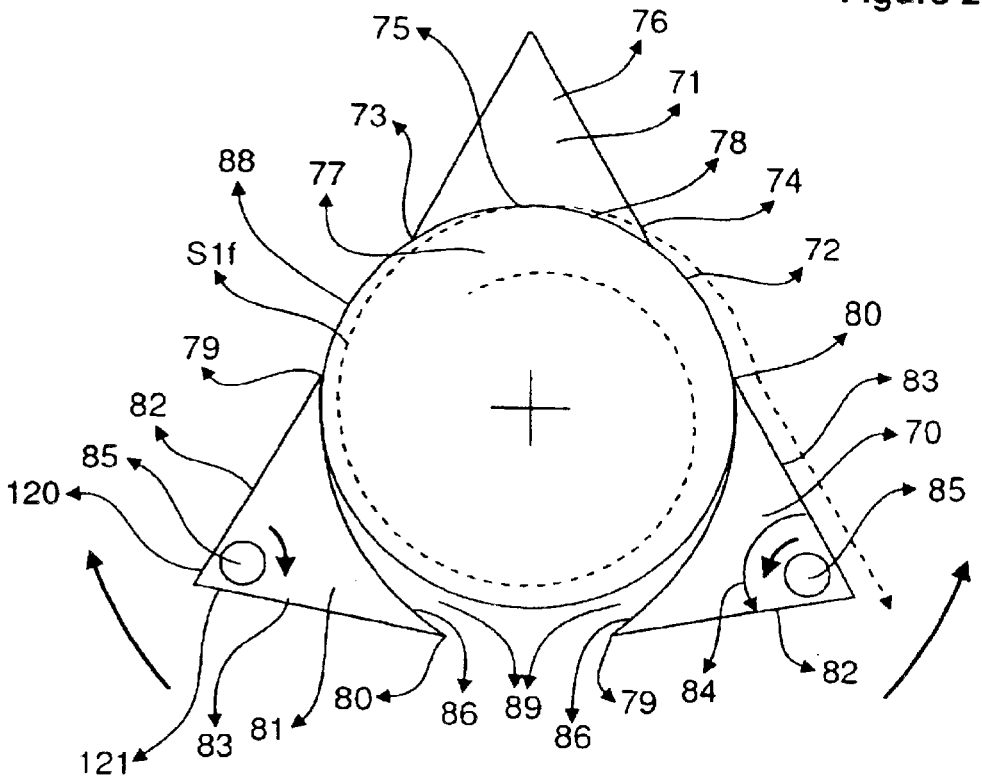
FIG. 27 diagrammatically shows the construction of the symmetric outer guide combination from FIGS. 4 and 5, pivotly attached.

FIG. 27 diagrammatically shows the construction of the outer guide combination (28) from FIGS. 13 and 14 in more detail (70). This construction is of major importance to the device of the invention. With an outer guide combination the opening (75) between the respective central feeds (73)(74) has to be closed of because the cavity (76) will otherwise fill with material which will unbalance the rotor. Furthermore, such material bed will extend (far) on to the meter face (77), which will hinder the movement of the material from the meter face (77) to the respective central feeds (79)(80) along the first spiral particle flow (S1), reducing rotor capacity to a considerable degree, while the particle size that can be handled is also limited. When such a outer guide combination (71) is attached clamped to the edge (88) of the meter face (77), the surface (75) between the respective central feeds (73)(74) can be closed off by a circular wall (78);

however, such a wall (78) will not avoid the build-up of a material bed, because of its tangential position. The device of the invention provides the possibility for the spiral forward and backward material stream (S1*f*)(S1*b*) to flow essentially unhindered to the respective central feeds (79)(80) of the respective forward (82) and backward (83) directed guide members of the outer guide combinations (81)(70). This is achieved by attaching the guide combination (81) pivotly (85) at a location (85) between the delivery ends (120)(121) and by widening the angle (84) between the respective forward (82) and backward (83) directed guide members without changing their respective lenghts, which creates an opening (89) between the central feeds (80)(79) and the edge (88) of the meter face (77). When the opening between the respective central feeds (79)(80) are now closed off with a circular shaped wall (86) with a radius equal to the radius of the edge (77) of the meter face (88) the guiding unit can be positioned with either the forward (79) or backward (80) directed central feed located against the edge (88) of the meter face (77), which creates a transit opening (89) between the opposite central feeds and the edge (88) of the meter face (77), while the circular wall (86) between the central feeds (79)(80) is aligned in outward direction in this position, which does not allow for material to stick against the wall (86) and build up a bed of material. This transit opening (89) allows for the spiral material stream (S2*f*)(S1*b*) to flow virtually unhindered from the meter face (77) to the respective central feeds (79)(80) which makes it possible to operate the rotor at high capacity and with relatively coarse particle material. Moreover, the specific location of the pivot attachment (85) lets the guiding unit take its forward (81) and backward (70) position automatically under influence of the rotational forces.

Figure 28:
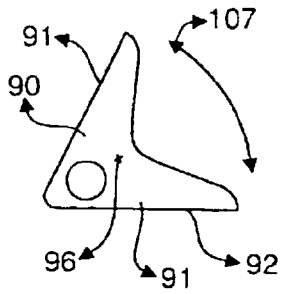
FIG. 28 diagrammatically shows a symmetric inner impact unit, pivotly attached.
Figure 29:
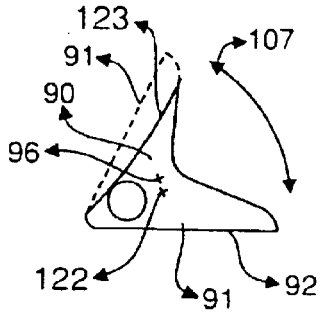
FIG. 29 shows the outer impact unit form FIG. 28 with one weared-off impact face.
Figure 30:
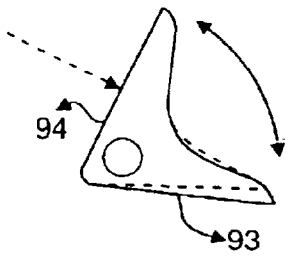
FIG. 30 diagrammatically shows the outer impact unit from FIG. 28 in a not completely symmetric configuration.
Figure 31:
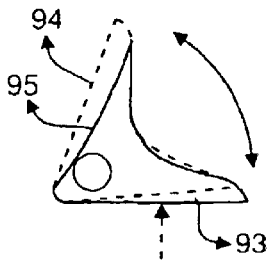
FIG. 31 diagrammatically shows the outer impact unit from FIG. 30 with one weared-off impact face.

FIG. 28 shows a symmetric impact unit (90) equipped with a primary (91) and secondary (92) directed impact face. When operated first in primary direction of rotation (107), the in place impact face (91) will wear-off, transferring the centre of gravity (122), into the direction of the secondary primary impact face (92); as is illustrated in FIG. 29. This causes the secondary impact face (92) also to change position which effects impact intensity when the rotation of the rotor is altered, because the secondary impact face (92) is no longer optimally aligned. The device of the invention provides the possibility to avoid such shift by constructing the impact unit (90) slightly asymmetrically; that is, as is illustrated in FIG. 30, with the secondary impact face (93) positioned slightly forward in respect to the primary impact face (94); essentially to such a degree that the secondary impact face (93) takes gradually its intended position when the primary impact face (94) wears off (95), as is illustrated in FIG. 31.

Figure 32:
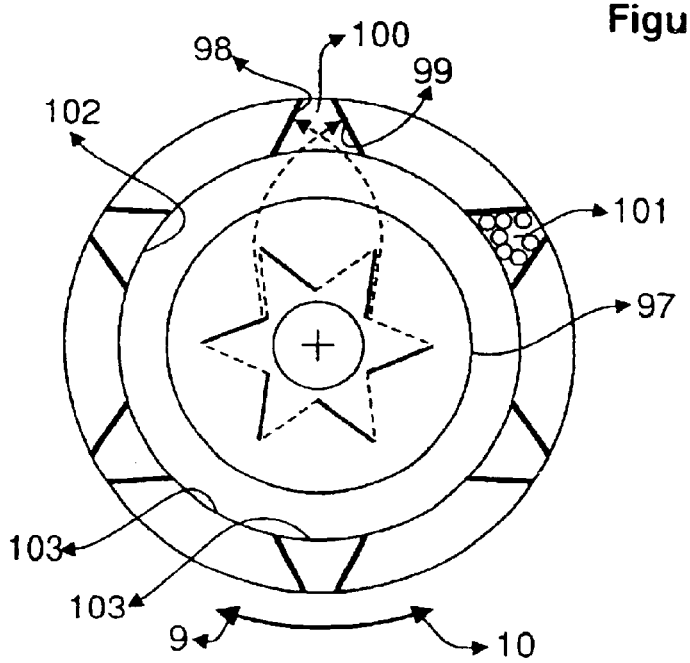
FIG. 32 diagrammatically illustrates an seventh supersymmetric configuration of a rotor equipped with outer adjacent guide combinations, adjustable attached, and impact members with the impact faces of the forward and backward directed impact members positioned front to front, positioned in a hollow impact ring construction.

FIG. 32 diagrammatically shows a seventh supersymmetric configuration of a rotor (97), essentially similar to the rotor (56) in FIG. 24, where pairs of forward (98) and backward directed (99) impact faces are positioned, mirror imaged front to front, relatively close to each other, in a ring construction (105). This way cavities (100) are created between the respective impact faces (98)(99), in which cavities (100) own material can accumulate forming a bed of own material which can act as an autogenous impact face (101) which limits wear; such impact face (101) has not a comminution intensity of a hard metal impact face, but has still a significant impact efficiency. However, depending on the distance (102) between the respective impact faces (98)(99) a combination of autogenous and metal impact, or semi-autogenous impact, can be created, increasing the level of comminution intensity. In the bottom plate of the rotor the area in front of the autogenous impact faces (102) has to be open, preferably all around to allow the impacting material to be thrown after impact out of the rotor in downward direction, which limits wear along the outer edge (103) of the openings.

Figure 33:
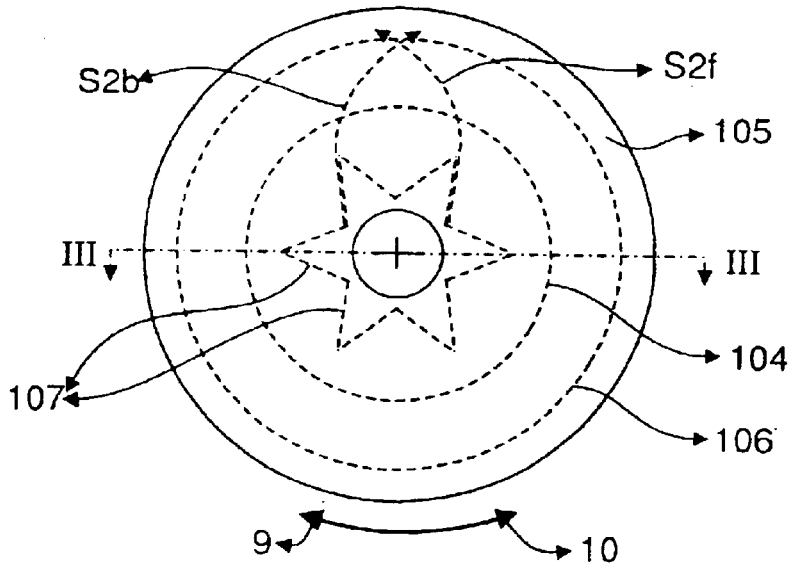
FIG. 33 diagrammatically shows a top view on IV-IV of a symmetric configuration of a rotor with outer adjacent guide combinations, pivotly attached, with the rotatable collision means formed by a rotatable autogenous hollow impact ring construction which can rotate either forward or backward.
Figure 34:
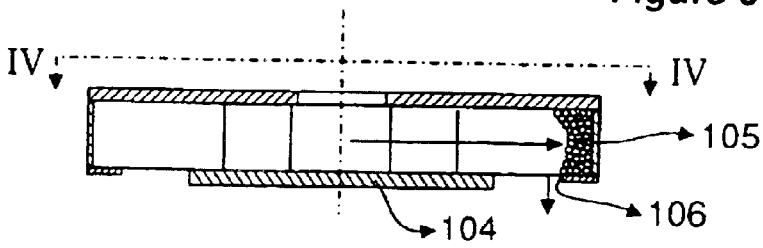
FIG. 34 diagrammatically shows a longitudinal section on III—III of FIG. 33.

FIGS. 33 and 34 diagrammatically shows a configuration of a rotor (104) where the collision means are not designed as separate (pairs) of impact members, but as a rotatable autogenous ring (105) which is supported by the rotor (104) and located concentrically around the meter face at a greater radial distance from the axis of rotation then the delivery ends, which autogenous ring (105) has a trough structure with the opening directed towards the inside, when seen from the axis of rotation and a circular opening in the bottom plate of the rotor all around located directly in front of the bottom edge of said autogenous ring. The centrifugally thrown material (S2*f*)(S2*b*) now builds up a bed of own material (105) under influence of centrifugal forces, which autogenous ring (105) acts as a rotatable autogenous impact member.

Such a system can of course be operated in one direction of rotation only; reversal of change of direction of rotation has however the advantage that the autogenous bed is provided with new own material (refreshed). Such a rotatable autogenous ring has limited impact intensity when compared with a rotatable metal impact member but has a high comminution efficiency while wear is nihil; in a rotatable autogenous rotor (104) wear only develops along the guide members (107), which can be designed short and aligned strongly backward which limits wear along the inner bottom edge (106) of the autogenous ring significantly. Because the material is falling downward after impact, it is accelerated by gravitational force limiting sliding wear along this edge (106). The material leaves the rotor with a velocity virtually equal to the pheripheral velocity (106) of the rotatable autogenous ring (105); such wear is considerably less when compared with the wear that develops along the tip ends of a conventional rotor equipped with tangentially aligned autogenous arms for acceleration of the material only.

Figure 35:
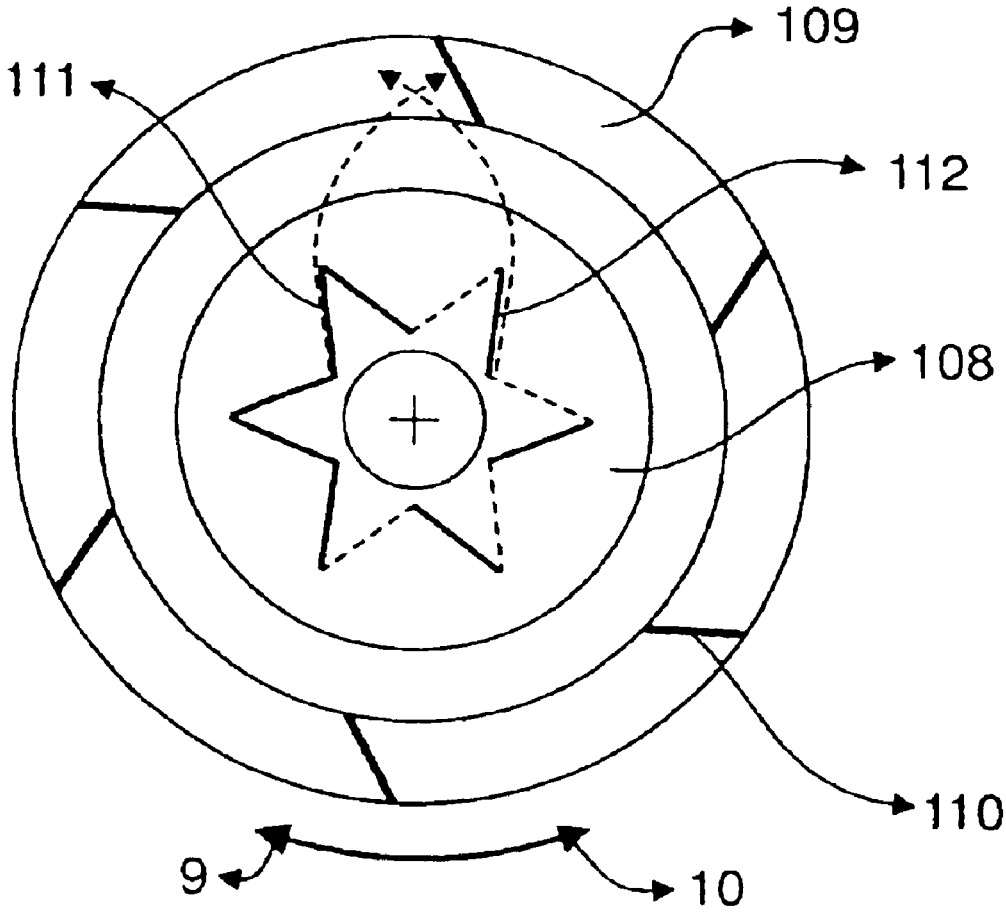
FIG. 35 diagrammatically shows an indirect configuration of a rotor equipped with a hollow impact ring with outer adjacent guide combinations, adjustable attached, which rotor can be used for different purposes when rotating in respectively forward and backward direction, that is, semi-autogenous in one direction and steel impact in the other direction.

FIG. 35 shows an indirect symmetrical configuration of a rotor (108) which is equipped with a rotatable autogenous ring (109) which is supported by the rotor (108) and located concentrically around the meter face at a greater radial distance from the axis of rotation than the delivery ends, which autogenous ring (109) has a trough structure with the opening directed towards the inside, when seen from the axis of rotation, where a co-rotating autogenous bed of material is formed, in which autogenous ring (109) are positioned only forward directed impact members (110) which are associated with the forward directed guide members (111). The backward directed guide members (112) are associated with the rotatable autogenous ring (109). So this rotor makes steel impact possible when rotating in backward direction (10) and autogenous impact when rotating in forward direction (9).

Figure 36:
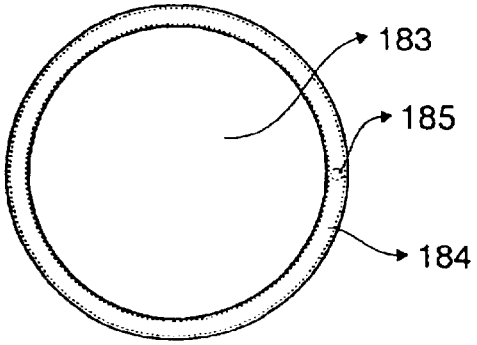
FIG. 36 diagrammatically shows a rotor which is equipped with a hollow balance ring.
Figure 37:
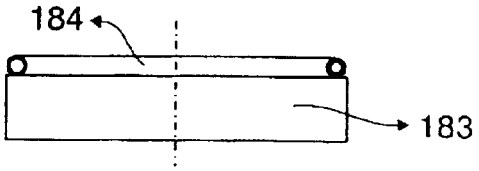
FIG. 37 diagrammatically shows a rotor which is equipped with a hollow balance ring.

FIGS. 36 and 37 diagrammatically show a rotor (183) which is equipped with a hollow balance ring (184) which is positioned on top of the rotor (183) and is at least partly filled with oil and contains at least one ball (185) for balancing the rotor (183). The hollow opening of the balance ring (184) is here circular.

Figure 38:
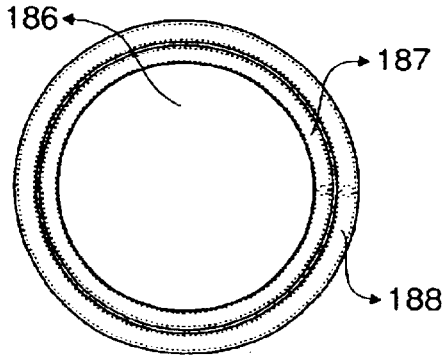
FIG. 38 diagrammatically shows a rotor which is equipped with two hollow balance rings.
Figure 39:
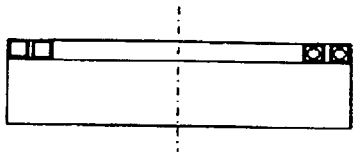
FIG. 39 diagrammatically shows a rotor which is equipped with two hollow balance rings.

FIGS. 38 and 39 diagrammatically show a similar situation as in FIGS. 36 and 37 where to rotor (186) is equipped with two balance rings (187)(188) which are positioned on top of the rotor (186) next to each other. The hollow opening of the balance rings (187)(188) is here square.

Figure 40:
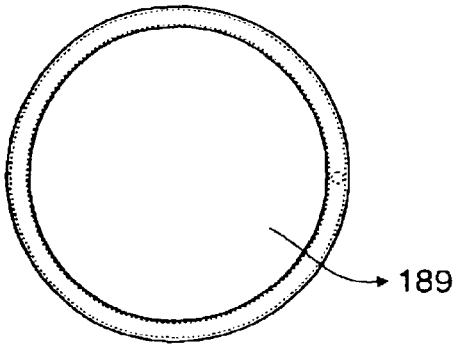
FIG. 40 diagrammatically shows a rotor which is equipped with two hollow balance rings.
Figure 41:
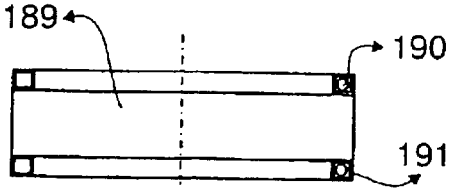
FIG. 41 diagrammatically shows a rotor which is equipped with two hollow balance rings.

FIGS. 40 and 41 diagrammatically show a similar situation as in FIGS. 36 and 37 where to rotor (189) is equipped with two balance rings; one balance ring (190) on top of the rotor (189) and one balance ring (191) against the bottom of the rotor (189).

Figure 42:
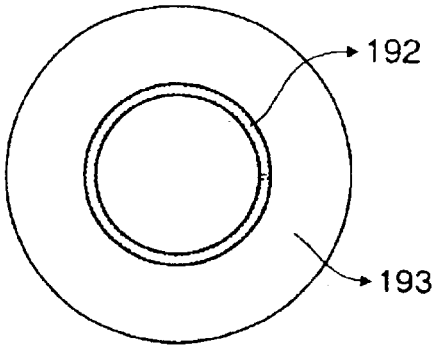
FIG. 42 diagrammatically shows a smaller balance ring.
Figure 43:
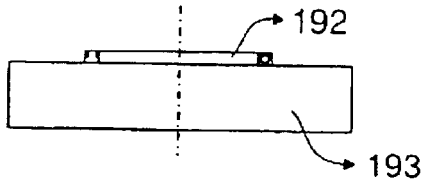
FIG. 43 diagrammatically shows a smaller balance ring.

FIGS. 42 and 43 diagrammatically show a smaller balance ring (192) located on top of the rotor (193) more towards the centre of the rotor (193).

The degree of unbalance that can be balanced with these balance rings increases with the diameter of the balance ring, the diameter of the hollow opening, the diameter, number and weight of the balls and the number of balance rings that are installed.

The forgoing descriptions of specific embodiments of the present invention have been presented for purposes of illustration and description. They are not intended to be exhaustive of to limit the invention of the precise forms disclosed, and obviously many modifications and variations are possible in light of the above feaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A device for making a material collide in a rotating system, comprising:

a rotor which can rotate about a central axis of rotation in clockwise direction, here called forward, as well as in anti-clockwise direction, here called backward;

a forward guide member, which is supported by said rotor and is provided with a forward directed guide face with an inner and an outer edge, for accelerating and guiding a stream of the material which, in a region close to said axis of rotation, is metered on said rotor, said forward guide member extending in the direction of the external edge of said rotor, which material comes off the said forward guide member and is sent into a backward spiral stream (Sb), when rotating forward and when seen from a viewpoint which moves together with said forward guide member;

a backward guide member, which is supported by said rotor and is at least provided with a backward directed guide face with an inner and an outer edge, for accelerating and guiding a stream of the material which, in a region close to said axis of rotation, is metered on said rotor, said backward guide member extending in the direction of the external edge of said rotor, which material comes off said backward guide member and is sent into a forward spiral stream (Sf), when rotating backward and when seen from a viewpoint which moves together with said backward guide member;

a forward impact unit which is supported by said rotor and is linked with said forward guide member and includes a forward impact member which is provided with a forward directed impact face, which is associated with said forward guide member for simultaneously loading and accelerating the stream of material on impact when rotating forward, said forward directed impact face lies entirely behind, when seen in the direction of rotation, the radial line on which is situated the location where the as yet uncollided stream of material leaves said forward guide member, and at a greater radial distance from said axis of rotation than the location at which the as yet uncollided stream of material leaves said forward guide member, the position of said forward impact face is determined by the forward synchronization angle (θf) between the radial line on which is situated the location where the as yet uncollided stream of material leaves said forward guide member and the radial line on which is situated the location where said backward spiral stream (Sb) of the as yet uncollided stream of material and the forward path (Cf) of said forward impact face intersect one another, said forward synchronization angle (θf) is selected in such a manner that the arrival of the as yet uncollided material at the location where said backward spiral stream (Sb) and said forward path (Cf) intersect one another is synchronized with the arrival at the same location of said forward impact face, said forward impact face is directed virtually transversely, when seen in the plane of the rotation, to said backward spiral stream (Sb) which the as yet uncollided material describes, when seen from a viewpoint which moves together with said forward impact member;

a backward impact unit which is supported by said rotor and is linked with said backward guide member and includes a backward impact member which is provided with a backward directed impact face, which is associated with said backward guide member for simultaneously loading and accelerating the stream of material on impact when rotating backward, said backward directed impact face lies entirely behind, when seen in the direction of rotation, the radial line on which is situated the location where the as yet uncollided stream of material leaves said backward guide member, and at a greater radial distance from said axis of rotation than the location at which the as yet uncollided stream of material leaves said backward guide member, the position of said backward impact face is determined by the backward synchronization angle (θb) between the radial line on which is situated the location where the as yet uncollided stream of material leaves said backward guide member and the radial line on which is situated the location where said forward spiral stream (Sf) of the as yet uncollided stream of material and the backward path (Cb) of said backward impact face intersect one another, said backward synchronization angle (θb) is selected in such a manner that the arrival of the as yet uncollided material at the location where said forward spiral stream (Sf) and said backward path (Cb) intersect one another is synchronized with the arrival at the same location of said backward impact face, said backward impact face is directed virtually transversely, when seen in the plane of the rotation, to said forward spiral stream (Sf) which the as yet uncollided material describes, when seen from a viewpoint which moves together with said backward impact member in such a way that said forward directed second spiral stream does not interfere with any of the forward directed impact faces.

2. The device according to claim 1, wherein, said forward impact unit is provided with at least two of the forward impact members, which each have a forward impact face that can be individually associated with said forward guide member, and said backward impact unit is provided with at least two of the backward impact members, which each have a backward impact face that can be individually associated with said backward guide member.

3. The device according to claim 2, wherein said individual associations are achieved by changing at least the position of a respective said guide face of one of said forward and backward guide members.

4. The device according to claim 2, wherein said individual associations are achieved by changing at least the position of a respective said impact face of one of said forward and backward impact members.

5. The device according to claim 1, having a configuration of:

at least two similar ones of said forward impact unit being circumferentially disposed uniformly at equal angular distances around said axis of rotation; and ones of the backward impact unit, in number equal to the forward impact units, being circumferentially disposed uniformly at equal angular distances around said axis of rotation.

6. The device according to claim 5, the configuration being symmetric with said forward impact member arranged together with a said backward impact member, as an arranged pair next to each other, virtually completely joined together back to back, as an adjacent impact combination.

7. The device according to claim 6, with said impact combination being movably supported by said rotor in such a way that said impact combination can be positioned into forward and backward positions.

8. The device according to claim 7, with said impact combination being movable around a second point at a location essentially between said combined impact members.

9. The device according to claim 8, with said impact combination being pivotly attached to said rotor at a second pivot at a location essentially between said combined impact members.

10. The device according to claim 9, with the radial distance between said axis of rotation and the point of gravity of said pivotly attached impact combination being smaller then the equal radial distance to the location of said second pivot, in such a way that said pivotly attached impact combination is self-positioning, which is achieved by having the impact combination tumble automatically into forward and backward positions when the direction of rotation is reversed from forward into backward and visa versa.

11. The device according to claim 7, with said impact combination being manually adjustable attached to said rotor at a location essentially between said combined impact members.

12. The device according to claim 5, the configuration being symmetric with said forward impact member arranged together with a said backward impact member, as an arranged pair next to each other, virtually partly joined together back to back, with the respective inner sections positioned close to each other, with the outer sections positioned at further distance from each other than said inner sections, as an inner impact combination.

13. The device according to claim 5, the configuration being symmetric with said forward impact member arranged together with a said backward impact member, as an arranged pair next to each other, virtually partly joined together front to front, with the respective outer sections positioned close to each other, with the inner sections positioned at further distance from each other than said outer sections, as an outer impact combination.

14. The device according to claim 13, the impact faces of said outer impact combination being connected together at least along their bottom edges with a plate, in such a way that a bed of own material can be formed on said plate between said impact faces, which said bed acts as an autogenous impact face.

15. The device according to claim 5, said impact faces being not of straight design at least in longitudinal direction.

16. The device according to claim 5, having a super-symmetric configuration:

with said forward and backward guide members being arranged together as guide combinations; and with said forward and backward impact members being arranged together as impact combinations.

17. The device according to claim 5, the configuration being symmetric with each said forward guide member arranged together with a said backward guide member, as an arranged pair next to each other, virtually completely joined together back to back, as an adjacent guide combination.

18. The device according to claim 17, having said backward guide face of said guide combination functioning as a forward pre-guide face when rotating forward, and vice versa when rotating backward.

19. The device according to claim 5, the configuration being symmetric with each said forward guide member arranged together with a said backward guiding member, as an arranged pair next to each other, virtually partly joined together back to back, with the respective inner sections positioned close to each other, with the outer sections positioned at further distance from each other than said inner sections, as an inner guide combination.

20. The device according to claim 19, with said guide combination being movably supported by said rotor in such a way that said guide combination can be positioned into forward and backward positions.

21. The device according to claim 20, with said guide combination being movable around a first point at a location essentially between said combined guide members.

22. The device according to claim 21, with said guide combination being pivotly attached to said rotor a first pivot at a location essentially between said combined guide members.

23. The device according to claim 22, with the radial distance between said axis of rotation and the point of gravity of said pivotly attached guide combination being smaller then the equal radial distance to the location of said first pivot, in such a way that said pivotly attached guide combination is self-positioning, which is achieved by having the guide combination tumble automatically into forward and backward positions when the direction of rotation is reversed from forward into backward and visa versa.

24. The device according to claim 20, with said guide combinations being manually adjustable attached to said rotor at a location essentially between said combined guide members.

25. The device according to claim 5, the configuration being symmetric with each said forward guide member arranged together with a said backward guiding member, as an arranged pair next to each other, virtually partly joined together back to back, with the respective outer sections positioned close to each other, with the inner sections positioned at further distance from each other than said outer sections, as an outer guide combination.

26. The device according to claim 25, having a pre-guide member positioned essentially symmetrically between said inner sections, which pre-guide member is provided with a pre-guide face for pre-guiding of the material, with said pre-guide face functioning forward when rotating forward, and vice versa when rotating backward.

27. The device according to claim 1, said guide faces being not of straight design at least in longitudinal direction.

28. The device according to claim 1, having a hollow impact ring which has a trough structure which is at least partly open along the side facing said axis of rotation, which circular hollow impact ring is supported by said rotor and is located concentrically around said axis of rotation at a greater radial distance from said axis of rotation than the outer edge of said guide member, in which trough structure a co-rotating autogenous bed of own material is formed.

29. The device according to claim 28, with said impact ring having at least one opening for discharging of the material.

30. The device according to claim 28, with at least one said impact unit being positioned in said impact ring.

31. The device according to claim 1, with at least one circular hollow balance ring attached to said rotor, the center of which said circular balance ring coincides with said axis of rotation, said hollow balance ring is at least partly filled with oil and contains at least one ball for reducing vibration of said rotor.

32. The device according to claim 31, said at least one ball being composed of a metal alloy.

33. The device according to claim 31, with said at least one ball being composed of ceramic material.

* * * * *